US008317457B2

(12) United States Patent
Wadia et al.

(10) Patent No.: US 8,317,457 B2
(45) Date of Patent: Nov. 27, 2012

(54) METHOD OF OPERATING A COMPRESSOR

(75) Inventors: Aspi Rustom Wadia, Loveland, OH (US); David Scott Clark, Liberty Township, OH (US); Ching-Pang Lee, Cincinnati, OH (US); Andrew Breeze-Stringfellow, Cincinnati, OH (US); Gregory Scott McNulty, Indianapolis, IN (US)

(73) Assignee: General Electric Company, Schenectady, NY (US)

( * ) Notice: Subject to any disclaimer, the term of this patent is extended or adjusted under 35 U.S.C. 154(b) by 1383 days.

(21) Appl. No.: 11/966,348

(22) Filed: Dec. 28, 2007

(65) Prior Publication Data

US 2010/0284780 A1 Nov. 11, 2010

(51) Int. Cl.
*F01D 11/20* (2006.01)

(52) U.S. Cl. ..... 415/1; 415/173.1; 415/173.2; 415/914

(58) Field of Classification Search ..... 415/1, 173.1–173.5, 914
See application file for complete search history.

(56) References Cited

U.S. PATENT DOCUMENTS

| | | | |
|---|---|---|---|
| 2,594,042 | A | 4/1952 | Lee |
| 3,300,121 | A | 1/1967 | Johnson |
| 5,161,944 | A | 11/1992 | Wood |
| 6,438,484 | B1 | 8/2002 | Andrew et al. |
| 6,607,350 | B2 | 8/2003 | Dodd |
| 6,666,017 | B2 | 12/2003 | Prentice et al. |
| 6,715,984 | B2 | 4/2004 | Nakajima et al. |
| 6,793,455 | B2 | 9/2004 | Prasad et al. |
| 6,871,487 | B2 | 3/2005 | Kurtz et al. |
| 6,973,771 | B2 | 12/2005 | Nottin |
| 7,159,401 | B1 | 1/2007 | Kurtz et al. |
| 7,334,394 | B2 | 2/2008 | Samimy et al. |
| 7,588,413 | B2 | 9/2009 | Lee et al. |
| 7,628,585 | B2 | 12/2009 | Lee et al. |
| 7,695,241 | B2 | 4/2010 | Lee et al. |
| 7,736,123 | B2 | 6/2010 | Lee et al. |

(Continued)

FOREIGN PATENT DOCUMENTS

DE 102006008864 9/2006

(Continued)

OTHER PUBLICATIONS

Vo, H.D., "Suppression of Short Length-Scale Rotating Stall Inception With Glow Discharge Actuation"; ASME Turbo Expo 2007; Power for Land, Sea and Air; May 14-17, 2007, Montreal, Canada; Ecole Polytechnique de Montreal Department of Mechanical Engineering; Montreal, Quebec, Canada; pp. 267-278; Copyright 2007 by ASME.*

(Continued)

*Primary Examiner* — Christopher Verdier
(74) *Attorney, Agent, or Firm* — General Electric Company; Matthew P. Hayden; David J. Clement

(57) ABSTRACT

A method of operating a compressor having a row of blades for preventing a compressor stall is disclosed, the method comprising the steps of mounting a plasma generator in a casing or a shroud radially outwardly and apart from the blade tips wherein the plasma generator comprises a radially inner electrode and a radially outer electrode separated by a dielectric material; and supplying an AC potential to the radially inner electrode and the radially outer electrode.

20 Claims, 8 Drawing Sheets

U.S. PATENT DOCUMENTS

| | | | | |
|---|---|---|---|---|
| 7,766,599 | B2 | 8/2010 | Lee et al. | |
| 7,819,626 | B2 * | 10/2010 | Lee et al. | 415/173.2 |
| 7,870,720 | B2 | 1/2011 | Hagseth et al. | |
| 7,871,719 | B2 | 1/2011 | Houchin-Miller et al. | |
| 7,984,614 | B2 | 7/2011 | Nolcheff | |
| 8,006,497 | B2 | 8/2011 | Nolcheff et al. | |
| 2004/0011917 | A1 | 1/2004 | Saeks et al. | |
| 2008/0089775 | A1 | 4/2008 | Lee et al. | |
| 2008/0101913 | A1 | 5/2008 | Lee et al. | |
| 2008/0128266 | A1 | 6/2008 | Lee et al. | |
| 2008/0131265 | A1 | 6/2008 | Lee et al. | |
| 2008/0145210 | A1 | 6/2008 | Lee et al. | |
| 2008/0145233 | A1 | 6/2008 | Lee et al. | |
| 2009/0065064 | A1 * | 3/2009 | Morris et al. | 415/173.1 |
| 2009/0169356 | A1 | 7/2009 | Wadia et al. | |
| 2009/0169362 | A1 | 7/2009 | Wadia et al. | |
| 2009/0169363 | A1 | 7/2009 | Wadia et al. | |
| 2009/0169367 | A1 | 7/2009 | Wadia et al. | |
| 2010/0047055 | A1 | 2/2010 | Wadia et al. | |
| 2010/0047060 | A1 | 2/2010 | Wadia et al. | |
| 2010/0170224 | A1 | 7/2010 | Clark et al. | |
| 2010/0172747 | A1 | 7/2010 | Clark et al. | |
| 2010/0284780 | A1 | 11/2010 | Wadia et al. | |
| 2010/0284785 | A1 | 11/2010 | Wadia et al. | |
| 2010/0284786 | A1 | 11/2010 | Wadia et al. | |
| 2010/0284795 | A1 | 11/2010 | Wadia et al. | |

FOREIGN PATENT DOCUMENTS

| | | |
|---|---|---|
| EP | 1329595 | 7/2003 |
| EP | 1413713 | 4/2004 |
| EP | 1607574 | 12/2005 |
| EP | 1672966 | 6/2006 |
| EP | 1906136 | 4/2008 |
| EP | 1908927 | 4/2008 |
| EP | 1914385 | 4/2008 |
| EP | 1914391 | 4/2008 |
| EP | 1918520 | 5/2008 |
| EP | 1926353 | 5/2008 |
| EP | 1936116 | 6/2008 |
| EP | 1936117 | 6/2008 |
| FR | 1031925 | 6/1953 |
| GB | 2191606 | 12/1987 |
| JP | 2008270110 | 11/2008 |
| WO | 9403862 | 2/1994 |
| WO | 9935893 | 7/1999 |
| WO | 03038282 | 5/2003 |
| WO | WO-2005-114013 A1 * | 12/2005 |
| WO | 2008154592 | 12/2008 |
| WO | 2009018532 | 2/2009 |

OTHER PUBLICATIONS

Vo, H.D., "Control of Rotating Stall in Axial Compressors Using Plasma Actuators"; Ecole Polytechnique de Montreal, Montreal, Canada; AIAA 2007-3845; pp. 1-15.*

Corke, Thomas C., et al., "Overview of Plasma Flow Control: Concepts, Optimization, and Applications", 43rd AIAA Aerospace Science Meeting and Exhibit, Jan. 10-13, 2005, Reno, Nevada, AIAA 2005-563, American Institute of Aeronautics and Astronauts, Inc.

Opaits, D.F., et al., "Plasma Control of Boundary Layer Using Low-Temperature Non-Equilibrium Plasma of Gas Discharge", 43rd AIAA Aerospace Science Meeting and Exhibit, Jan. 10-13, 2005, Reno, Nevada, AIAA 2005-1180, American Institute of Aeronautics and Astronauts, Inc.

Hultgren, Lennart S., et al., "Demonstration of Separation Delay With Glow-Discharge Plasma Actuators", 41st AIAA Aerospace Science Meeting and Exhibit, Jan. 6-9, 2003, Reno, Nevada, AIAA 2003-1025, American Institute of Aeronautics and Astronauts, Inc.

Huang, Junhui, et al, "Unsteady Plasma Actuators for Separation Control of Low-Pressure Turbine Blades", AIAA Journal, vol. 44, No. 7, Jul. 2006, pp. 1147-1157, American Institute of Aeronautics and Astronauts, Inc.

Rivir, R.B., et al., "Control of Separation in Turbine Boundary Layers", 2nd AIAA Flow Control Conference, Jun. 28-Jul. 1, 2004, Portland, Oregon, AIAA 2004-2201, American Institute of Aeronautics and Astronauts, Inc.

Corke, Thomas C., et al., "Plasma Flow Control Optimized Airfoil", 44th AIAA Aerospace Sciences Meeting and Exhibit, Jan. 9-12, 2006, Reno, Nevada, AIAA 2006-1208, American Institute of Aeronautics and Astronauts, Inc.

Visbal, Miguel R., et al., "Control of Transitional and Turbulent Flows Using Plasma-Based Actuators", 36th AIAA Fluid Dynamics Conference and Exhibit, Jun. 5-8, 2006, San Francisco, California, AIAA 2006-3230, American Institute of Aeronautics and Astronauts, Inc.

Rivir, R., et al., "AC and Pulsed Plasma Flow Control", 42nd AIAA Aerospace Sciences Meeting and Exhibit, Jan. 5-8, 2004, Reno, Nevada, AIAA 2004-847, American Institute of Aeronautics and Astronauts, Inc.

Balcer, Brian E., et al., "Effects of Plasma Induced Velocity on Boundary Layer Flow", 44th AIAA Aerospace Sciences Meeting and Exhibit, Jan. 9-12, 2006, Reno, Nevada, AIAA 2006-875, American Institute of Aeronautics and Astronauts, Inc.

Santhanakrishnan, Arvind, et al., "Flow Control Using Plasma Actuators and Linear/Annular Plasma Synthetic Jet Actuators", 3rd AIAA Flow Control Conference, Jun. 5-8, 2006, San Francisco, California, AIAA 2006-3033, American Institute of Aeronautics and Astronauts, Inc.

Jukes, Timothy N., et al., "Turbulent Drag Reduction by Surface Plasma through Spanwise Flow Oscillation", 3rd AIAA Flow Control Conference, Jun. 5-8, 2006, San Francisco, California, AIAA 2006-3693, American Institute of Aeronautics and Astronauts, Inc.

Christensen, D. et al., "Development and Demonstration of a Stability Management System for Gas Turbine Engines," Proceedings of GT2006, ASME Turbo Expo 2006: Power for Land, Sea and Air, Barcelona, Spain, GT2006-90324, (May 8-11, 2006).

Corke, T.C., et al., "SDBD plasma enhanced aerodynamics: concepts, optimization and applications"; Progress in Aerospace Sciences 43 (2007); pp. 193-217; Hessert Laboratory for Aerospace Research, Center for Flow Physics and Control, University of Notre Dame, Notre Dame, IN 46556, USA.

Douville, T. et al., "Turbine Blade Tip Leakage Flow Control by Partial Squealer Tip and Plasma Actuators"; AIAA Aerospace Sciences Meeting, vol. AIAA 2006-20; Jan. 1, 2006; pp. 263-280.

Goksel, B. et al, "Active Flow Control, in Turbomachinery Using Phased Plasma Actuators", Internet Citation, [online]. Apr. 1, 2004; XP007907306; retrieved from the Internet: URL:http://www.electrofluidsystems.com/news/goksel-ISABE2005.pdf>[retrieved on Feb. 19, 2009].

Morris, S.C., et al.; "Tip Clearance Control Using Plasma Actuators"; 43rd AIAA Aerospace Sciences Meeting and Exhibit, Jan. 10-13, 2005, Reno, Nevada; AIAA 2005-782; pp. 1-8.

Patel, M.P. et al., "Autonomous Sensing and Control of Wing Stall Using a Smart Plasma Slat"; Journal of Aircraft; vol. 44, No. 2, Mar.-Apr. 2007.

Van Ness II, D.K. et al., "Stereo PIV of a Turbine Tip Clearance Flow with Plasma Actuation", AIAA paper 2006-21, Jan. 1, 2006, pp. 1-11, XP009112404.

Van Ness II, D.K. et al., "Turbine Tip Clearance Flow Control using Plasma Actuation", AIAA paper 2006-21, Jan. 1, 2006, pp. 1-11, XP009112404.

Wikipedia Contributors: "Dielectric barrier discharge"; Internet Citation, [online] p. 1, XP007907353; retrieved from the Internet: URL:http://en.wikipedia.org/w/index.php?title=Dielectric_barrier_discharge&oldid=255196896>[retrieved on Jan. 1, 2009].

Wikipedia Contributors: "Plasma (physics)"; Internet Citation, [online] pp. 1-16, XP007907356; retrieved from the Internet: URL:http://en.wikipedia.org/w/index.php?title=Plasma_physics&oldid=2729329>[retrieved on Feb. 24, 2009].

Wu, Y. et al., "Experimental investigation of using plasma aerodynamic actuation to extend low-speed axial compressor's stability"; Hangkong-Dongli-Xuebao:Jikan=Journal of Aerospace Power, Beijing Hangkong Xueyuan Chubanshe, Beijing, vol. 22, No. 12, Dec. 1, 2007, pp. 2025-2030, XP009112656; ISSN: 100-8055.

Written Opinion mailed Mar. 17, 2009 for corresponding Application No. PCT/US2008/084319.

International Search Report mailed Mar. 17, 2009 for corresponding Application No. PCT/US2008/088355.

Written Opinion mailed Mar. 17, 2009 for corresponding Application No. PCT/US2008/088355.
International Search Report mailed Mar. 17, 2009 for corresponding Application No. PCT/US2008/088182.
Written Opinion mailed Mar. 17, 2009 for corresponding Application No. PCT/US2008/088182.
International Search Report mailed Apr. 3, 2009 for corresponding Application No. PCT/US2008/088112.
Written Opinion mailed Apr. 3, 2009 for corresponding Application No. PCT/US2008/088112.
International Search Report mailed Apr. 3, 2009 for corresponding Application No. PCT/US2008/088369.
Written Opinion mailed Apr. 3, 2009 for corresponding Application No. PCT/US2008/088369.
International Search Report mailed Apr. 7, 2009 for corresponding Application No. PCT/US2008/088370.
Written Opinion mailed Apr. 7, 2009 for corresponding Application No. PCT/US2008/088370.
International Search Report mailed Jun. 8, 2009 for corresponding Application No. PCT/US2008/088116.
Written Opinion mailed Jun. 8, 2009 for corresponding Application No. PCT/US2008/088116.
International Search Report mailed Aug. 18, 2009 for corresponding Application No. PCT/US2008/085650.
International Search Report mailed Mar. 11, 2009 for corresponding Application No. PCT/US2008/084315.
Written Opinion mailed Mar. 11, 2009 for corresponding Application No. PCT/US2008/084315.
International Search Report mailed Mar. 17, 2009 for corresponding Application No. PCT/US2008/084319.
Written Opinion mailed Aug. 18, 2009 for corresponding Application No. PCT/US2008/085650.
International Preliminary Report on Patentability mailed Jul. 8, 2010 for corresponding Application No. PCT/US2008/084315.
International Preliminary Report on Patentability mailed Jul. 8, 2010 for corresponding Application No. PCT/US2008/088370.
International Preliminary Report on Patentability mailed Jul. 8, 2010 for corresponding Application No. PCT/US2008/088182.
International Preliminary Report on Patentability mailed Jul. 8, 2010 for corresponding Application No. PCT/US2008/088369.
International Preliminary Report on Patentability mailed Jul. 8, 2010 for corresponding Application No. PCT/US2008/088112.
International Preliminary Report on Patentability mailed Jul. 8, 2010 for corresponding Application No. PCT/US2008/084319.
International Preliminary Report on Patentability mailed Jul. 8, 2010 for corresponding Application No. PCT/US2008/085650.
International Preliminary Report of Patentability mailed Jul. 8, 2010 for corresponding Application No. PCT/US2008/088116.
International Preliminary Report on Patentability mailed Jul. 8, 2010 for corresponding Application No. PCT/US2008/088355.

* cited by examiner

METHOD OF OPERATING A COMPRESSOR

BACKGROUND OF THE INVENTION

This invention relates generally to gas turbine engines, and, more specifically, to the enhancement of stable flow range of compression systems therein, such as fans, boosters and compressors using plasma actuators.

In a turbofan aircraft gas turbine engine, air is pressurized in a fan module, a booster module and a compression module during operation. The air passing through the fan module is mostly passed into a by-pass stream and used for generating the bulk of the thrust needed for propelling an aircraft in flight. The air channeled through the booster module and compression module is mixed with fuel in a combustor and ignited, generating hot combustion gases which flow through turbine stages that extract energy therefrom for powering the fan, booster and compressor rotors. The fan, booster and compressor modules have a series of rotor stages and stator stages. The fan and booster rotors are typically driven by a low pressure turbine and the compressor rotor is driven by a high pressure turbine. The fan and booster rotors are aerodynamically coupled to the compressor rotor although these normally operate at different mechanical speeds.

Fundamental in the design of compression systems, such as fans, boosters and compressors, is efficiency in compressing the air with sufficient stall margin over the entire flight envelope of operation from takeoff, cruise, and landing. However, compression efficiency and stall margin are normally inversely related with increasing efficiency typically corresponding with a decrease in stall margin. The conflicting requirements of stall margin and efficiency are particularly demanding in high performance jet engines that operate under operating conditions such as severe inlet distortions and increased auxiliary power extractions, while still requiring high a level of stall margin in conjunction with high compression efficiency.

Compressor system stalls are commonly caused by flow breakdown at the tip of the compressor rotor. In a gas turbine high pressure compressor, there are tip clearances between rotating blade tips and a stationary casing that surrounds the blade tips. During the engine operation, the compression air leaks from the pressure side through the tip clearance toward the suction side. These leakage flows may cause vortices to form at the tip region of the blade. The vortices may grow in intensity and size, causing blockage and loss when the compression system is throttled and may ultimately lead to a compression system stall and reduction of efficiency.

Accordingly, it would be desirable to have a compression system wherein the blade tip vortex blockage and loss are minimized to enhance the operability of the engine by delaying the onset of a stall in the compression system. It would be desirable to have a system for reducing the tip leakage flow by reducing effective clearance between the tip of the rotating blades and a casing or shroud surrounding the blade tips. It would be desirable to have a method for operating an aircraft gas turbine engine for improving the stable flow range and efficiency of the compression systems of the engine.

BRIEF DESCRIPTION OF THE INVENTION

The above-mentioned need or needs may be met by exemplary embodiments which provide a plasma leakage flow control system for a compressor, comprising a circumferential row of compressor blades, an annular casing surrounding the tips of the blades, located radially apart from the tips of the blades and at least one annular plasma generator located on the annular casing. The annular plasma generator comprises an inner electrode and an outer electrode separated by a dielectric material. A gas turbine engine having a plasma leakage flow control system further comprises an engine control system which controls the operation of the annular plasma generator such that the blade tip leakage flow can be changed.

In another aspect of the present invention, a gas turbine engine with a plasma leakage flow control system in a compression stage further comprises an engine control system which controls the operation of the plasma generator such that the blade tip leakage flow can be changed.

In an exemplary embodiment, the plasma generator is mounted to a segmented shroud. In another exemplary embodiment, the plasma actuator has an annular configuration. In another exemplary embodiment the plasma actuator system comprises a discrete plasma generator.

An aircraft gas turbine engine may be operated using a method for operating the plasma generator system for improving the stable flow range of the compression systems in the engine. In another aspect of the invention, an aircraft gas turbine engine may be operated using a method for reducing the tip leakage flow by reducing effective clearance between the tip of the rotating blades and a casing or shroud surrounding the blade tips. An aircraft gas turbine engine may be operated using a method for operating the plasma generator system for changing the operating efficiency of a compressor.

BRIEF DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
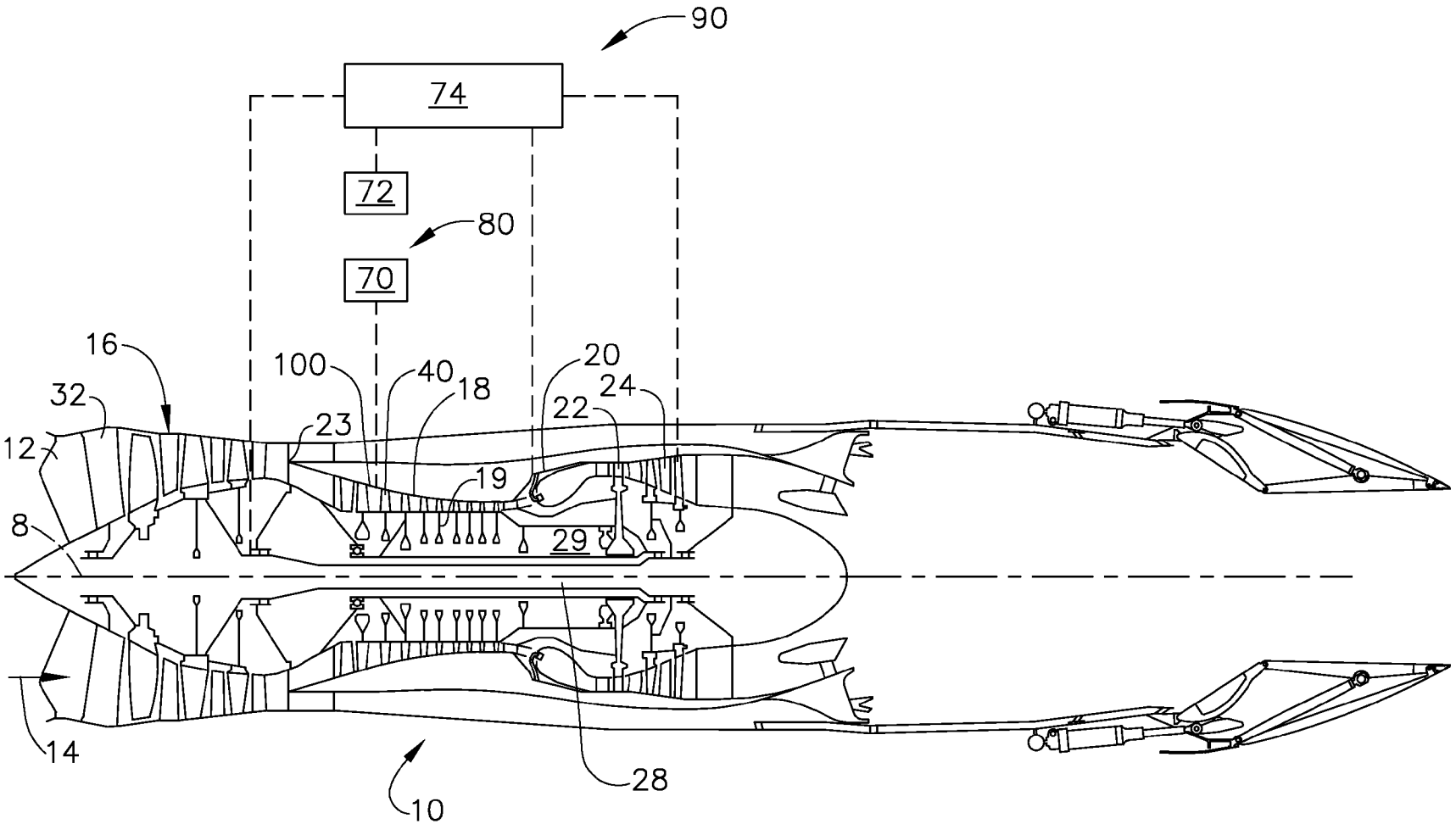
FIG. 1 is a schematic cross-sectional view of a gas turbine engine with an exemplary embodiment of a plasma actuator system in a compression stage.

Referring to the drawings wherein identical reference numerals denote the same elements throughout the various views, FIG. 1 shows an exemplary turbofan gas turbine engine 10 incorporating an exemplary embodiment of the present invention. It comprises an engine centerline axis 8, fan 12 which receives ambient air 14, a booster or low pressure compressor (LPC) 16, a high pressure compressor (HPC) 18, a combustor 20 which mixes fuel with the air pressurized by the HPC 18 for generating combustion gases or gas flow which flows downstream through a high pressure turbine (HPT) 22, and a low pressure turbine (LPT) 24 from which the combustion gases are discharged from the engine 10. The HPT 22 is joined to the HPC 18 to substantially form a high pressure rotor 29. A low pressure shaft 28 joins the LPT 24 to both the fan 12 and the booster 16. The second or low pressure shaft 28 is rotatably disposed co-axially with and radially inwardly of the first or high pressure rotor.

The HPC 18 that pressurizes the air flowing through the core is axisymmetrical about the longitudinal centerline axis 8. The HPC includes a plurality of inlet guide vanes (IGV) 30 and a plurality of stator vanes 31 arranged in a circumferential direction around the longitudinal centerline axis 8. The HPC 18 further includes multiple rotor stages 19 which have corresponding rotor blades 40 extending radially outwardly from a rotor hub 29 or corresponding rotors in the form of separate disks, or integral blisks, or annular drums in any conventional manner.

Figure 2:
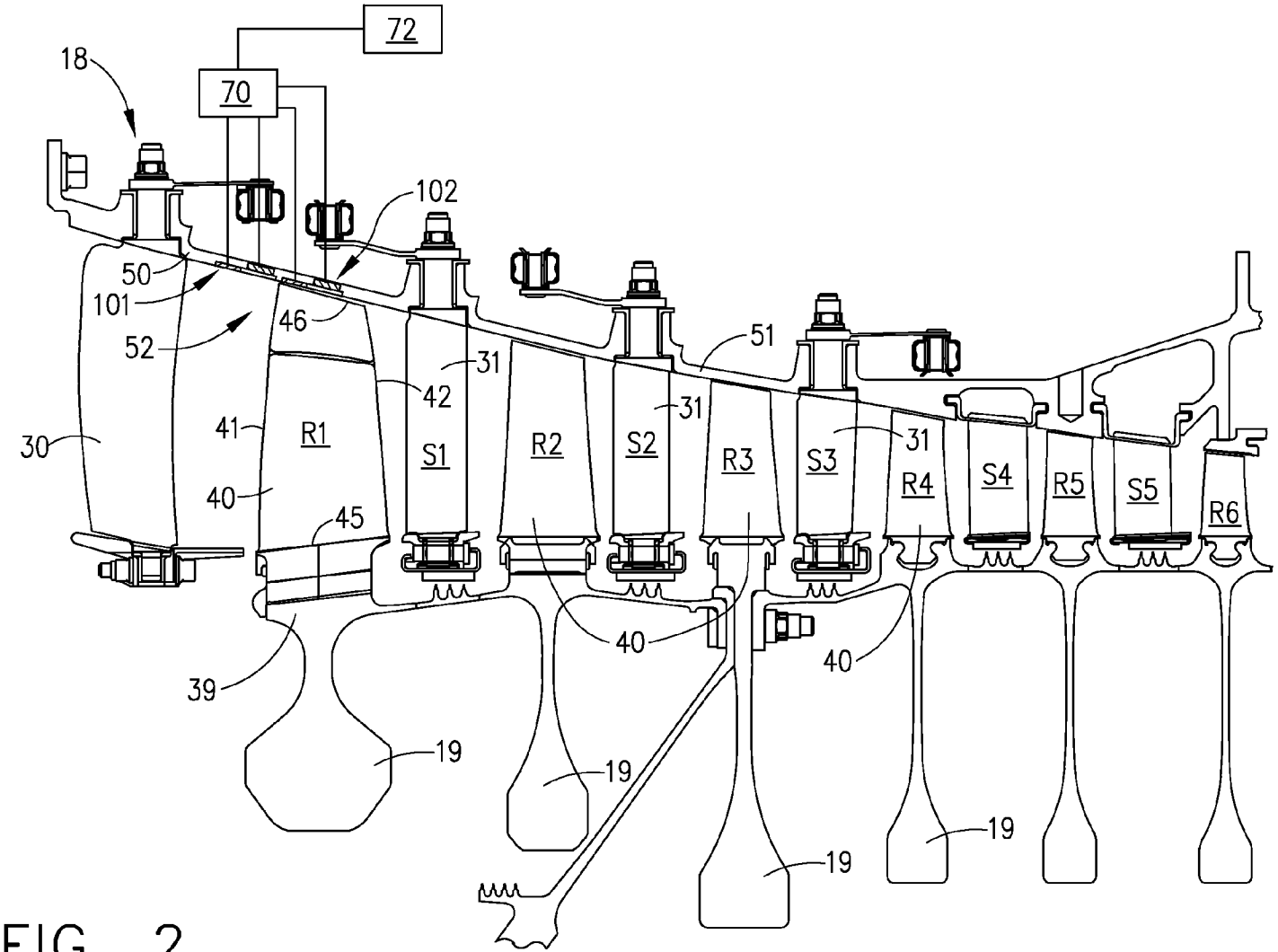
FIG. 2 is an enlarged cross-sectional view of a portion of the compressor of the gas turbine engine shown in FIG. 1.

Cooperating with each rotor stage 19 is a corresponding stator stage comprising a plurality of circumferentially spaced apart stator vanes 31. The arrangement of stator vanes and rotor blades is shown in FIG. 2. The rotor blades 40 and stator vanes 31 define airfoils having corresponding aerodynamic profiles or contours for pressurizing the core airflow successively in axial stages. Each rotor blade 40 comprises a blade root 45, a blade tip 46, a pressure side 43, a suction side 44, a leading edge 41 and a trailing edge 42. The front stage rotor blades 40 rotate within an annular casing 50 that surrounds the rotor blade tips. The aft stage rotor blades typically rotate within an annular passage formed by shroud segments 51 that are circumferentially arranged around the blade tips 46. In operation, pressure of the air is increased as the air decelerates and diffuses through the stator and rotor airfoils.

Figure 3:
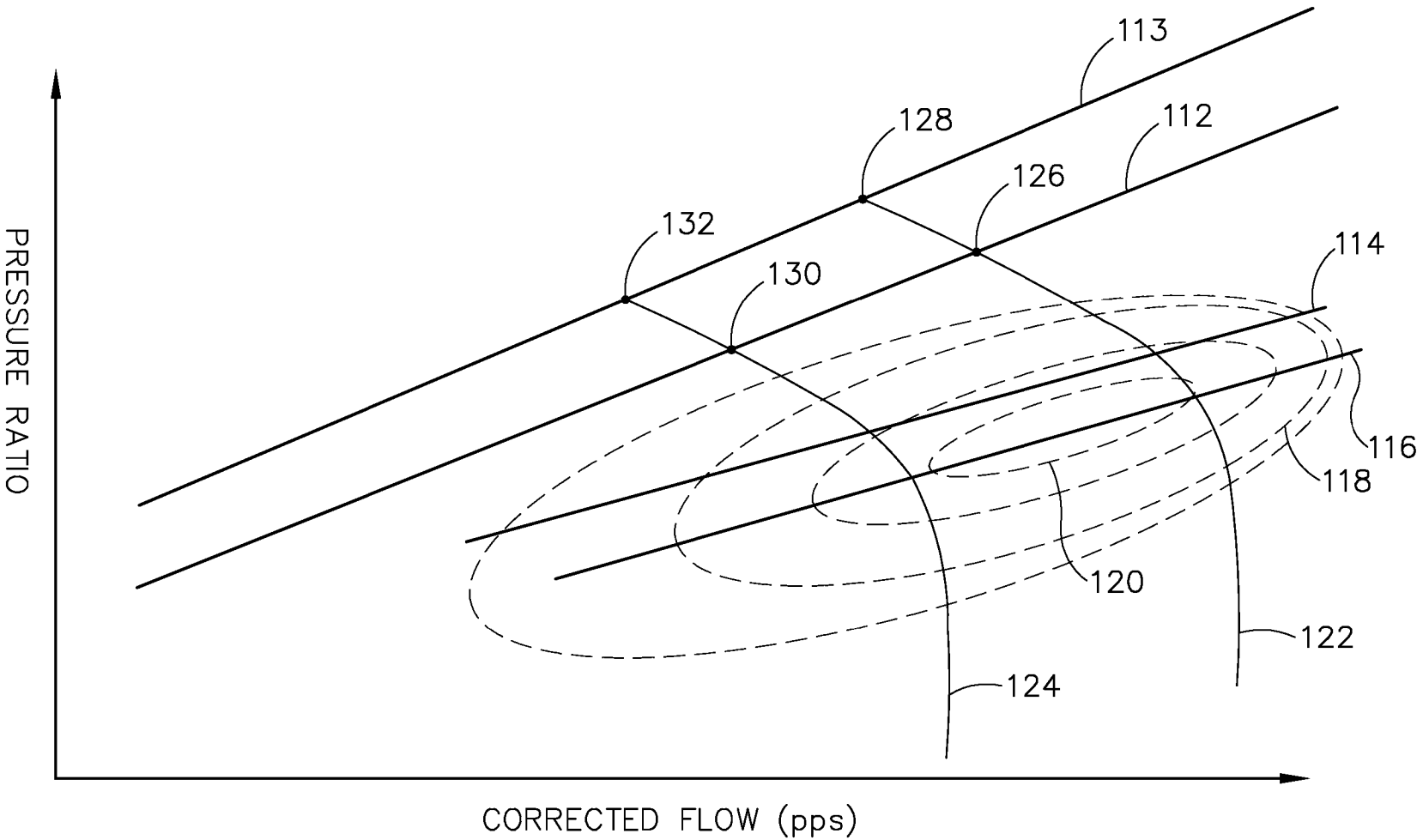
FIG. 3 is an exemplary operating map of a compressor shown in FIG. 2.

Operating map of the exemplary compression system 18 in the exemplary gas turbine engine 10 is shown in FIG. 3, with inlet corrected flow rate along the X-axis and the pressure ratio on the Y-axis. The term "pressure ratio", as used herein, is defined as the ratio of the total pressure at the exit of the compression system divided by the total pressure at the inlet of the compression system. An exemplary steady state operating line 116, a transient operating line 114 and the stall line 112 are shown, along with constant speed lines 122, 124. Line 124 represents a lower speed line and line 122 represents a higher speed line. As the compression system is throttled at a constant speed, such as constant speed line 124, the inlet corrected flow rate decreases while the pressure ratio increases, and the compression system operation moves closer to the stall line 112. The term "stall margin", as used herein, is defined as the ratio, at constant corrected flow, of the pressure ratio at stall and the pressure ratio on an operating line minus one [(PRstall/PRol)−1.0]. Each operating condition has a corresponding compressor efficiency, conventionally defined as the ratio of ideal compressor work (isentropic) input to actual work input required to achieve a given pressure ratio. The compressor efficiency of each operating condition is plotted on the compressor map in the form of contours of constant efficiency, such as items 118, 120 shown in FIG. 3. The performance map has a region of peak efficiency, depicted in FIG. 3 as the smallest contour 120, and it is desirable to operate the compressor in the region of peak efficiency as much as possible. As explained further below herein, the exemplary embodiments of the present invention provide a means of improving the stable operating range of compression systems by raising the stall line (see item 113 in FIG. 3) of the compression system without simply lowering the operating line 116 and sacrificing efficiency. In FIG. 3, the stall line for a conventional compressor is shown as item 112 and the stall line using exemplary embodiments of the present invention is shown as item 113. Points 128 and 132 represent the increased stable operating range achieved by exemplary embodiments of the present invention described herein, as compared to respectively corresponding points 126 and 130 for a conventional compression system.

Figure 4C:
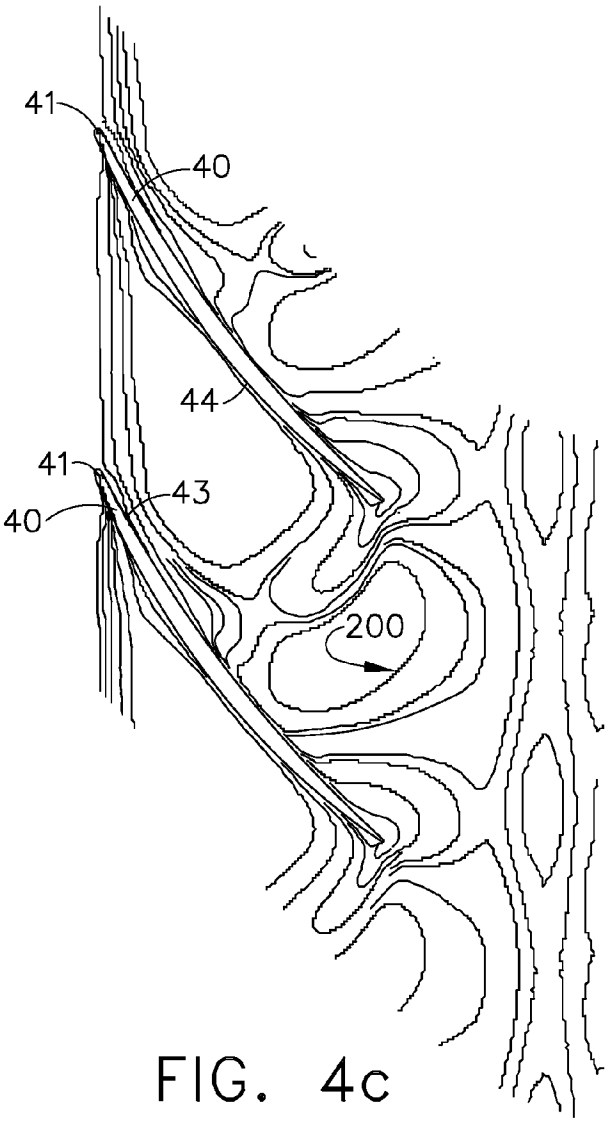
FIG. 4*c* shows the reversed flow in the vortex at the blade tip region during a stall.
Figure 4B:
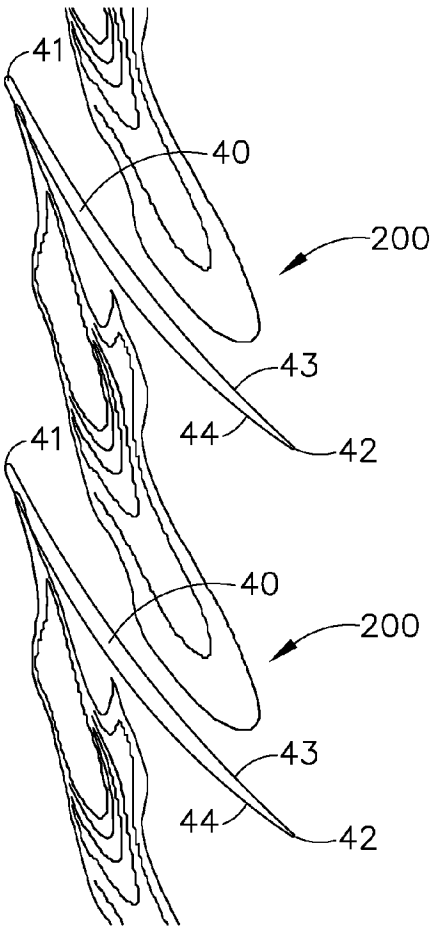
FIG. 4*b* shows the spread of the region of reversed flow in the blade tip vortex shown in FIG. 4*a* as the compressor is throttled above the operating line.

Compressor stalls are known to be caused by a breakdown of flow in the tip region 52 of the rotor 19. This tip flow breakdown is associated with tip leakage vortex schematically shown in FIGS. 4*a*, 4*b* and 4*c* as contour plots of regions having a negative axial velocity, based from computational fluid dynamic analyses. Tip leakage vortex 200 initiates primarily at the rotor blade tip 46 near the leading edge 41. In the region of this vortex 200, there exists flow that has negative axial velocity, that is, the flow in this region is counter to the main body of flow and is highly undesirable. Unless interrupted, the tip vortex 200 propagates axially aft and tangentially from the blade suction surface 44 to the adjacent blade pressure surface 43 as shown in FIG. 4*b*. Once it reaches the pressure surface 43, the flow tends to collect in a region of blockage at the tip between the blades as shown in FIG. 4*c* and causes high loss. As the compressor is throttled towards stall line 112, the blockage becomes increasingly larger within the flow passage between the adjacent blades and eventually causes the compressor 18 to stall. Near stall, the behavior of the blade passage flow field structure, specifically the blade tip clearance vortex trajectory, is perpendicular to the axial direction wherein the tip clearance vortex 200 spans the leading edges 41 of adjacent blades 40, as shown in FIG. 4*c*. The vortex 200 starts from the leading edge 41 on the suction surface 44 of the blade 40 and moves towards the leading edge 41 on the pressure side of the adjacent blade 40 as shown in FIG. 4*c*.

The exemplary embodiments of the invention using plasma actuators disclosed herein, delay the growth of the blockage by the tip leakage vortex 200. The plasma actuators as applied and operated according to the exemplary embodiments of the present invention provide increased axial momentum to the fluid in the tip region 52. The plasma created in the tip region, as described below, strengthens the axial momentum of the fluid and minimizes the negative flow region 200 and also keeps it from growing into a large region of blockage. Plasma actuators used as shown in the exemplary embodiments of the present invention, produce a stream of ions and a body force that act upon the fluid in the tip vortex region, forcing it to pass through the blade passage in the direction of the desired fluid flow. The terms "plasma actuators" and "plasma generators" as used herein have the same meaning and are used interchangeably.

FIG. 2 schematically illustrates, in cross-section view, exemplary embodiments of plasma actuator systems 100 for increased stall margin and/or enhanced efficiency for compression systems in a gas turbine engine 10 such as the aircraft gas turbine engine illustrated in cross-section in FIG. 1. The gas turbine engine plasma actuator system 100 includes an annular casing 50, or annular shroud segments 51, surrounding rotatable blade tips 46. An annular plasma generator 60 is located on the casing 50, or the shroud segments 51, in annular grooves 54 or groove segments 56 spaced radially outward from the blade tips 46. The exemplary embodiment shown in FIG. 2 comprises a lead edge plasma actuator 101 located in the casing 50 near the tip 46 of the lead edge 41 and a part-chord plasma actuator 102 located in the casing 50 near the tip 46 of the blade at approximately the blade mid-chord.

Figure 5:
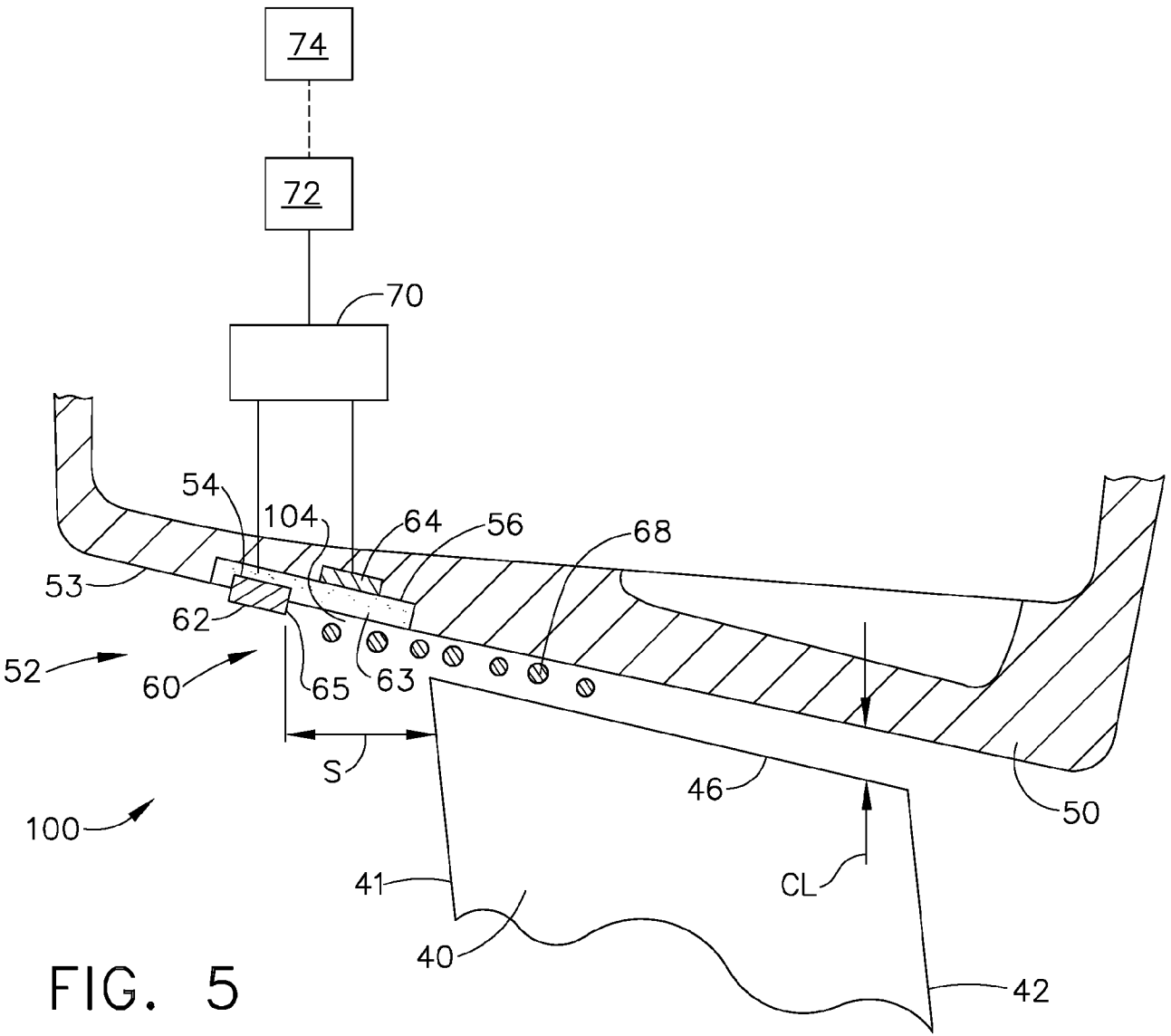
FIG. 5 is a schematic cross-sectional view of the tip region of a compressor with an exemplary embodiment of a plasma generator system.
Figure 8:
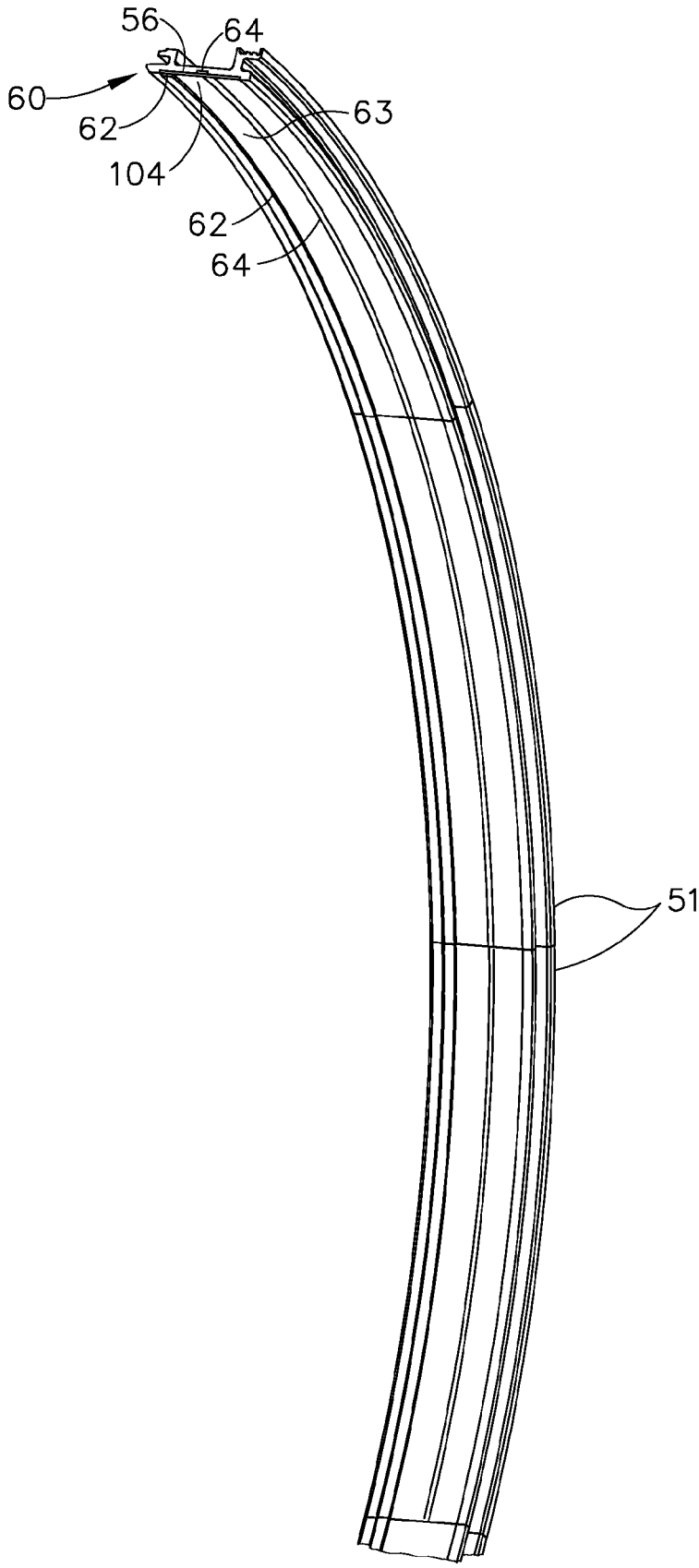
FIG. 8 is an isometric view of a shroud segment of a compressor with an exemplary embodiment of a plasma generator.

FIG. 5 shows an exemplary embodiment of a plasma actuator system 100 for increasing the stall margin and/or for enhancing the efficiency of a compression system 18. The term "compression system" as used herein includes devices used for increasing the pressure of a fluid flowing through it, and includes the high pressure compressor 18, the booster 16 and the fan 12 used in gas turbine engines shown in FIG. 1. The exemplary embodiment shown in FIG. 5 shows an annular plasma generator 60 mounted to the compressor casing 50 and includes a first electrode 62 and a second electrode 64 separated by a dielectric material 63. The dielectric material 63 is disposed within an annular groove 54 in a radially inwardly facing surface 53 of the casing 50. In some gas turbine engine designs, some of the stages of the compressor 18 may have annular shroud segments 51 surrounding the blade tips. FIG. 8 shows an exemplary embodiment using plasma actuators in shroud segments 51. As shown in FIG. 8, each of the shroud segments 51 includes an annular groove segment 56 with the dielectric material 63 disposed within the annular groove segment 56. This annular array of groove segments 56 with the dielectric material 63, first electrodes 62 and second electrodes 64 disposed within the annular groove segments 56 forms the annular plasma generator 60.

An AC power supply 70 is connected to the electrodes to supply a high voltage AC potential to the electrodes 62, 64. When the AC amplitude is large enough, the air ionizes in a region of largest electric potential forming a plasma 68. The plasma 68 generally begins near an edge 65 of the first electrode 62 which is exposed to the air and spreads out over an area 104 projected by the second electrode 64 which is covered by the dielectric material 63. The plasma 68 (ionized air) in the presence of an electric field gradient produces a force on the ambient air located radially inwardly of the plasma 68 inducing a virtual aerodynamic shape that causes a change in the pressure distribution over the radially inwardly facing surface 53 of the annular casing 50 or shroud segment 51. The air near the electrodes is weakly ionized, and usually there is little or no heating of the air.

During engine operation, the plasma actuator system 100 turns on the plasma generator 60 to form the annular plasma 68 between the annular casing 50 and blade tips 46. An electronic controller 72 which is linked to an engine control system 74, such as for example a Full Authority Digital Electronic Control (FADEC), which controls the fan speeds, compressor and turbine speeds and fuel system of the engine, may be used to control the plasma generator 60 by turning on and off of the plasma generator 60, or otherwise modulating it as necessary to increase the stall margin or enhancing the efficiency of the compression system. The electronic controller 72 may also be used to control the operation of the AC power supply 70 that is connected to the electrodes to supply a high voltage AC potential to the electrodes.

In operation, when turned on, the plasma actuator system 100 produces a stream of ions forming the plasma 68 and a body force which pushes the air and alters the pressure distribution near the blade tip on the radially inwardly facing surface 53 of the annular casing 50. The plasma 68 provides a positive axial momentum to the fluid in the blade tip region 52 where a vortex 200 tends to form in conventional compressors as described previously and as shown in FIGS. 4*a*, 4*b* and 4*c*. The positive axial momentum applied by the plasma 68 forces the air to pass through the passage between adjacent blades, in the desired direction of positive flow, avoiding the type of flow blockage shown in FIG. 4*c* for conventional engines. This increases the stall margin of the compressor stage and hence the compression system. Plasma generators 60, such for example, shown in FIG. 5, may be located around the tip of some selected compressor stages where stall is likely to occur. Alternatively, plasma generators may be located around tips of all the compression stages and selectively activated during engine operation using the engine control system 74 or the electronic controller 72.

Figure 4A:
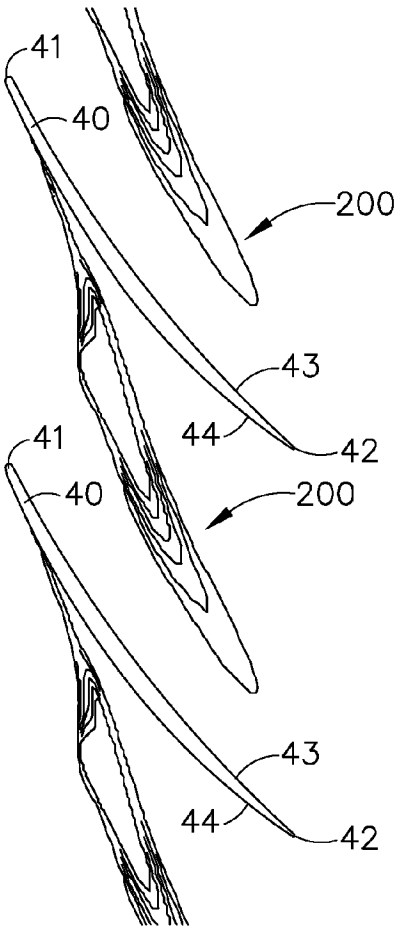
FIG. 4*a* shows the formation of a region of reversed flow in a blade tip vortex in a compression stage.

Plasma generators 60 may be placed axially at a variety of axial locations with respect to the blade leading edge 41 tip. They may be placed axially upstream from the blade leading edge 41 (see FIG. 5 for example). They may also be placed axially downstream from the leading edge 41 (see item marked "S" in FIGS. 6 and 7). Plasma generators are effective when placed in axial locations from about 10% blade tip chord upstream from the leading edge 41 to about 50% blade tip chord downstream from the leading edge 41. They are most effective when they can act directly upon the low momentum fluid associated with the tip vortex 200 such as, for example, shown in FIG. 4*a*. It is preferable to place the plasma generator such that plasma 68 stream influence started at about 10% blade tip chord, where the vortex is seen to start its growth, as shown in FIG. 4*a*. It is more preferable to locate the plasma generators at locations from about 10% chord aft of the leading edge 41 to about 50% chord.

Figure 6:
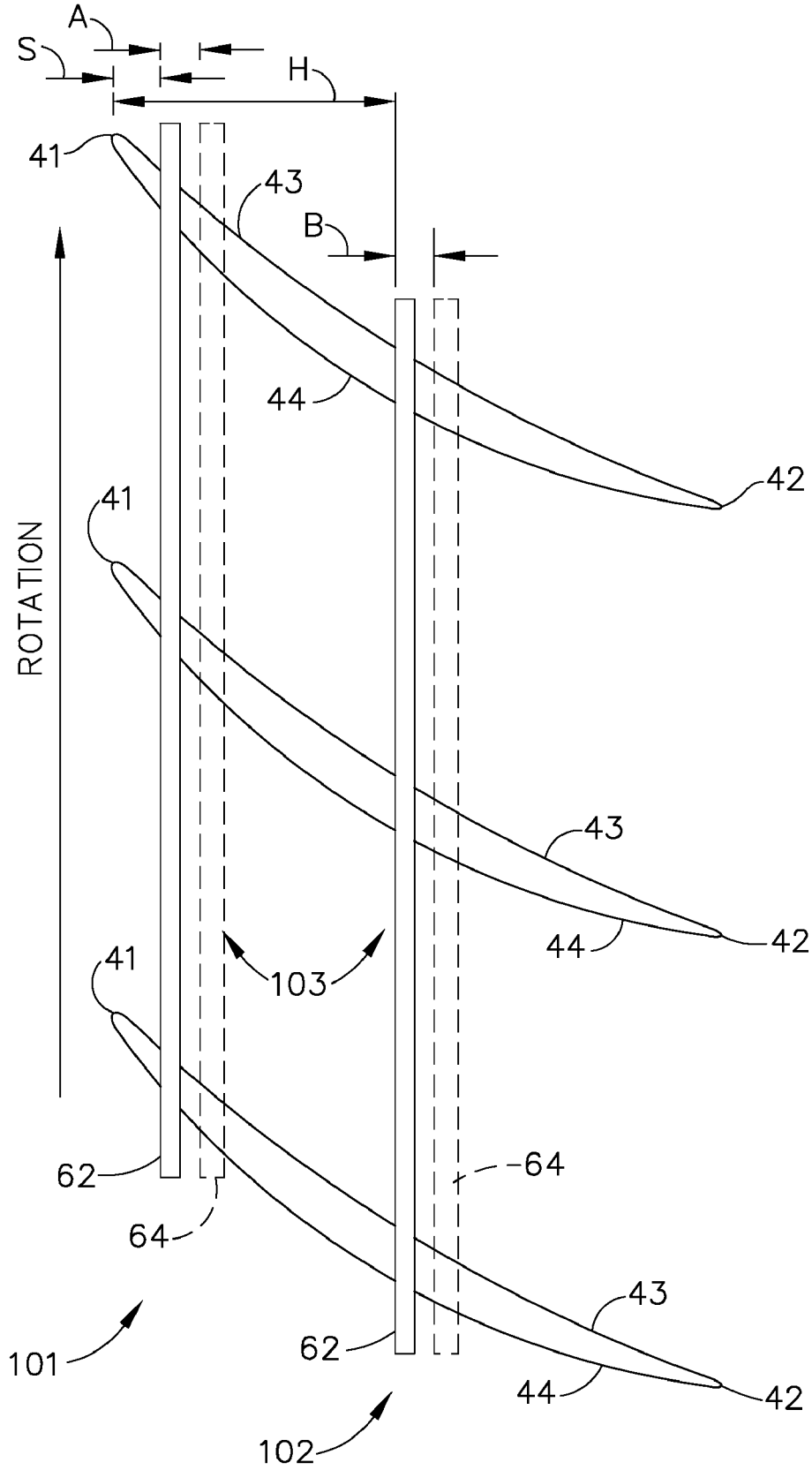
FIG. 6 is a schematic top view of the blade tips of a compressor with an exemplary embodiment of a plasma generator system.
Figure 7:
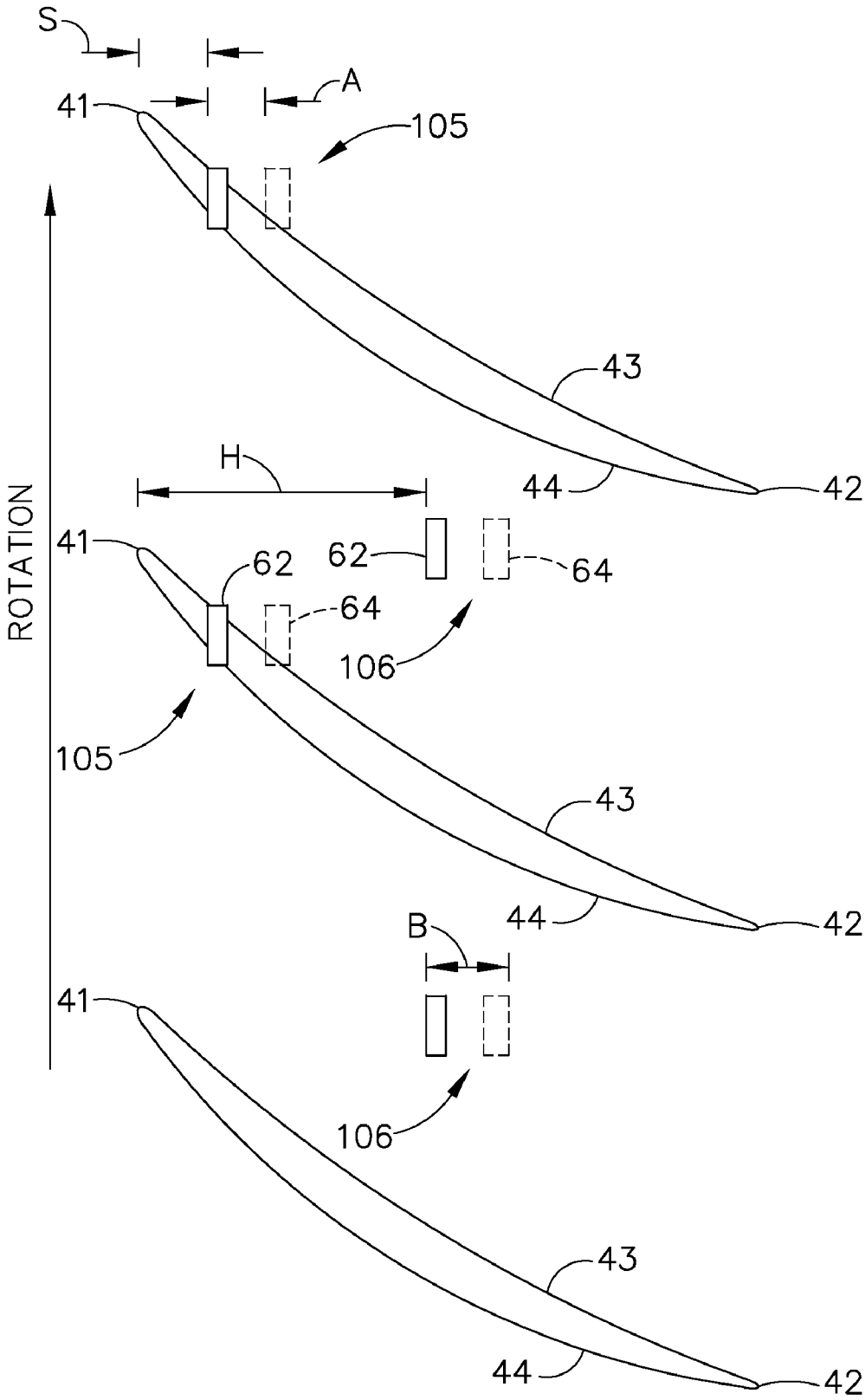
FIG. 7 is a schematic top view of the blade tips of a compressor with an exemplary embodiment of a plasma generator system.

In other exemplary embodiments of the present invention, it is possible to have multiple plasma actuators 101, 102 placed at multiple locations in the compressor casing 50 or the shroud segments 51. Exemplary embodiments of the present inventions having multiple plasma actuators at multiple locations are shown in FIGS. 6 and 7. FIG. 6 shows, schematically, an annular lead edge plasma actuator 101 located near the lead edge 41 and an annular part-chord plasma actuator 102 located near the mid-chord of the blade tips 46. In the exemplary embodiment shown in FIG. 6, the plasma actuators 101, 102 form a continuous annular loop 103 within the casing 50. The first electrodes 62 and the second electrodes 64 form continuous loops and are located axially apart by distances A and B that are selected based on the analyses of vortex formation using CFD analyses, such as for example shown in FIGS. 4*a* and 4*b*. The axial location of the lead edge plasma actuator 101 from the blade lead edge tip location ("S") and the axial location of the part-chord actuator 102 form the blade tip location ("H") are also chosen based on the CFD analyses of tip vortex formation. It has been determined that for the exemplary embodiments disclosed herein, it is best to place the lead edge plasma actuator 101 axially at about 10% rotor blade tip chord from the blade lead edge tip ("S"). The part-chord plasma actuator 102 may be placed axially between about 20% to 50% of the rotor blade tip chord from the blade lead edge tip ("H"). In a preferred embodiment, the value for "S" is about 10% rotor blade tip chord and the value for "H" is about 50% rotor blade tip chord.

In another exemplary embodiment shown in FIG. 7, discrete plasma actuators 105, 106 are arranged circumferentially in the casing 50 or the shroud segments 51. The number of discrete actuators 105 and 106 that are needed at a particular compression stage is based on the number blade counts used in that compression stage. In one exemplary embodiment, the number of discrete actuators 105, 106 used is the same as the number of blades in the compression stage and the circumferential spacing between the plasma actuators is the same as the blade row pitch. The axial locations and distances, S, H, A and B, and of the plasma actuators are selected as discussed previously herein in the case of continuous plasma actuators. The discrete plasma actuators, such as for example shown in FIG. 7, may also be arranged such that the plasma 68 is directed at an angle to the engine centerline axis 8. This may be accomplished, for example, by placing second electrode 64 of a discrete plasma actuator relative to the first electrode 62 such that the plasma 68 generated is directed at an angle relative to the engine centerline axis 8. It may be beneficial at some operating conditions to orient the plasma actuators to encourage the flow near the blade tip 46 to orient substantially in the same rotor-relative direction as the main body of flow through the blade passage. In one exemplary embodiment, this is achieved by locating the second electrode 64 of the plasma actuator 60 axially downstream of, and circumferentially offset from, the first electrode 62 such that they lie along substantially the same angle as the average rotor-relative flow direction at a selected operating condition.

In another aspect of the present invention and its exemplary embodiments disclosed herein, the plasma actuators can also be used so as to improve the compression efficiency of the compressor 18. It is commonly known to those skilled in the art that there is a very high degree of loss of momentum and increased entropy associated with leakage flows across compressor rotor blade 40 tips 46. Reducing such tip leakage will help reduce losses and improve compressor efficiency. Additionally, modifying the tip leakage flow directions and causing it to mix with the main fluid flow in the compressor at an angle closer to the main flow direction, will help reduce losses and improve compressor efficiency. Plasma actuators mounted on the compressor case 50 or the shroud segments 51 and used as disclosed herein accomplish these goals of reducing blade tip leakage flows and re-orienting it. In order to reduce tip leakage, the plasma actuator 60 is mounted near the blade tip chordwise point where the maximum difference in pressure exists between the blade pressure side 43 and suction side 44 static pressures. In the exemplary embodiments shown herein, that location is approximately at about 10% chord at blade tip. The location of the point of maximum static pressure difference at blade tip can be determined using CFD, as is well known in the industry. When turned on, the plasma actuators have a three-fold effect on the tip leakage flow. First, as in the stall margin enhancement application, the plasma created by the plasma generator 60 induces a positive axial body force on the tip leakage flow, thereby encouraging it to exit the rotor tip region 52 before high loss blockage is created. Second, the plasma generator 60 re-orients the tip leakage flow and causes it to mix with the main fluid flow at a more favorable angle to reduce loss. It is known that loss level in compression systems is a function of the angle between the streams of mixing fluid. Third, the plasma generator 60 reduces the effective flow area for the tip leakage flow and thereby leakage flow rate. Operating the plasma actuators 101, 102, 105, 106 on the casing 50 or shroud segments 51 above the compressor rotor blade tip 46 as shown in FIGS. 5, 6 and 7 creates a force that pushes the air in the tip region both in the axial direction and away from the rotor casing 50 and shroud segments 51. The effect of the plasma 68 pushing the boundary layer on the casing 50 and shroud segments 51 down into the tip clearance region causes the rotor blade 40 to run with a tighter effective tip clearance CL (see FIG. 5) and reduces the effective leakage flow area. This is especially valuable in axial flow compressors, where the low momentum fluid in the tip region is working against an adverse pressure gradient wherein the static pressure rises as air progresses through the axial compressor. In conventional compressors, this adverse pressure gradient works against the low momentum fluid in the tip vortex region and causes it to flow in the opposite direction, resulting in higher losses/low efficiency. The plasma actuators installed and used as disclosed herein facilitates the reduction of these adverse effects of the adverse pressure gradients at the blade tips.

The plasma actuator systems disclosed herein can be operated to effect an increase in the stall margin of the compression systems in the engine by raising the stall line, such as for example shown by the enhanced stall line 113 in FIG. 3. Although it is possible to operate the plasma actuators continuously during engine operation, it is not necessary to operate the plasma actuators continuously to improve the stall margin. At normal operating conditions, blade tip vortices and small regions of reversed flow 200 (see FIG. 4*a*) still exist in the rotor tip region 52. It is first necessary to identify the compressor operating points where the compressor is likely to stall. This can be done by conventional methods of analysis and testing and results can be represented on an operating map, such as for example, shown in FIG. 3. Referring to FIG. 3, at normal operating points on the operating line 116, for example, the stall margins with respect to the stall line 112 are adequate and the plasma actuators need not be turned on. However, as the compressor is throttled such as for example along the constant speed line 122, the axial velocity of the air in the compressor stage over the entire blade span from the blade root 45 to the blade tip 46 decreases, especially in the tip region 52. This axial velocity drop, coupled with higher pressure rise in the rotor blade tip 46, increases the flow over the rotor blade tip and the strength of the tip vortex, creating the conditions for a stall to occur. As the compressor operation approaches conditions that are typically near stall the stall line 112, the plasma actuators are turned on. The control system 74 and/or the electronic controller is set to turn the plasma actuator system on well before the operating points approach the stall line 112 where the compressor is likely to stall. It is preferable to turn on the plasma actuators early, well before reaching the stall line 112, since doing so will increase the absolute throttle margin capability. However, there is no need to expend the power required to run the actuators when the compressor is operating at healthy, steady-state conditions, such as on the operating line 116.

Alternatively, instead of operating the plasma actuators 101, 102, 104, 105 in a continuous mode as described above, the plasma actuators can be operated in a pulsed mode. In the pulsed mode, some or all of the plasma actuators 101, 102, 105, 106 are pulsed on and off at ("pulsing") some predetermined frequencies. It is known that the tip vortex that leads to a compressor stall generally has some natural frequencies, somewhat akin to the shedding frequency of a cylinder placed into a flowstream. For a given rotor geometry, these natural frequencies can be calculated analytically or measured during tests using unsteady flow sensors. These can be programmed into the operating routines in a FADEC or other engine control systems 74 or an electronic controller 72 for the plasma actuators. Then, the plasma actuators 101, 102, 105, 106 can be rapidly pulsed on and off by the control system at selected frequencies related, for example, to the vortex shedding frequencies or the blade passing frequencies of the various compressor stages. Alternatively, the plasma actuators can be pulsed on and off at a frequency corresponding to a "multiple" of a vortex shedding frequency or a "multiple" of the blade passing frequency. The term "multiple", as used herein, can be any number or a fraction and can have values equal to one, greater than one or less than one. The plasma actuator pulsing can be done in-phase with the vortex frequency. Alternatively, the pulsing of the plasma actuators can be done out-of-phase, at a selected phase angle, with the vortex frequency. The phase angle may vary between about 0 degree and 180 degrees. It is preferable to pulse the plasma actuators approximately 180 degrees out-of-phase with the vortex frequency to quickly break down the blade tip vortex as it forms. The plasma actuator phase angle and frequency may selected based on measurements of the tip vortex signals using probes mounted near the blade tip. Any suitable method of measuring the blade tip vortex signals using probes may be used, such as for example, by the use of dynamic pressure transducers made by Kulite Semiconductor Products.

During engine operation, the plasma blade tip clearance control system 90 turns on the plasma generator 60 to form the plasma 68 between the annular casing 50 (or the shroud segments 51) and blade tips 46. An electronic controller 72 may be used to control the plasma generator 60 and the turning on and off of the plasma generator 60. The electronic controller 72 may also be used to control the operation of the AC power supply 70 that is connected to the electrodes 62, 64 to supply a high voltage AC potential to the electrodes 62, 64. The plasma 68 pushes the air close to the surface away from the radially inwardly facing surface 53 of the annular casing 50 (or the shroud segments 51). This produces an effective clearance 48 between the annular casing 50 (or the shroud segments 51) and blade tips 46 that is smaller than a cold clearance between the annular casing 50 (or the shroud segments 51) and blade tips 46. The cold clearance is the clearance when the engine is not running. The actual or running clearance between the annular casing 50 (or the shroud segments 51) and the blade tips 46 varies during engine operation due to thermal growth and centrifugal loads. When the plasma generator 60 is turned on, the effective clearance 48 (CL) between the annular casing surface 53 and blade tips 46 (see FIG. 5) is smaller than when the actuator is turned off.

The cold clearance between the annular casing 50 (or the shroud segments 51) and blade tips 46 is designed so that the blade tips do not rub against the annular casing 50 (or the shroud segments 51) during high powered operation of the engine, such as, during take-off when the blade disc and blades expand as a result of high temperature and centrifugal loads. The exemplary embodiments of the plasma actuator systems illustrated herein are designed and operable to activate the plasma generator 60 to form the annular plasma 68 during engine transients when the operating line is raised (see item 114 in FIG. 3) where enhanced stall margins are necessary to avoid a compressor stall, or during flight regimes where clearances 48 have to be controlled such as for example, a cruise condition of the aircraft being powered by the engine. Other embodiments of the exemplary plasma actuator systems illustrated herein may be used in other types of gas turbine engines such as marine or perhaps industrial gas turbine engines.

In a segmented shroud 51 design, the segmented shrouds 51 circumscribe compressor blades 40 and helps reduce the flow from leaking around radially outer blade tips 46 of the compressor blades 40. A plasma generator 60 is spaced radially outwardly and apart from the blade tips 46. In this application on segmented shrouds 51, the annular plasma generator 60 is segmented having a segmented annular groove 56 and segmented dielectric material 63 disposed within the segmented annular groove 56. Each segment of shroud has a segment of the annular groove, a segment of the dielectric material disposed within the segment of the annular groove, and first and second electrodes separated by the segment of the dielectric material disposed within the segment of the annular groove.

An AC (alternating current) supply 70 is used to supply a high voltage AC potential, in a range of about 3-20 kV (kilovolts), to the electrodes (AC standing for alternating current). When the AC amplitude is large enough, the air ionizes in a region of largest electric potential forming a plasma 68. The plasma 68 generally begins at edges of the first electrodes spreads out over an area projected by the second electrodes which are covered by the dielectric material. The plasma 68 (ionized air) in the presence of an electric field gradient produces a force on the ambient air located radially inwardly of the plasma 68 inducing a virtual aerodynamic shape that causes a change in the pressure distribution over the radially inwardly facing surface 53 of the annular casing 50 (or the shroud segments 51). The air near the electrodes is weakly ionized, and there is little or no heating of the air.

The plasma blade tip effective clearance control system 90 can also be used in any compression sections of the engine such as the booster 16, a low pressure compressor (LPC), high pressure compressor (HPC) 18 and/or fan 12 which have annular casings or shrouds and rotor blade tips.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of operating a compressor having a row of blades for preventing a compressor stall, the method comprising the steps of:

mounting a plasma generator in a casing radially outwardly and apart from the blade tips wherein the plasma generator comprises a radially inner electrode and a radially outer electrode separated by a dielectric material; and supplying an AC potential to the radially inner electrode and the radially outer electrode;

wherein supplying the AC potential comprises pulsing the AC potential at a frequency that is a multiple of the number blades in the row of blades.

2. A method according to claim 1, wherein the dielectric material is disposed within a groove in a radially inwardly facing surface of the casing.

3. A method as claimed in claim 1, wherein the plasma generator comprises an annular plasma generator.

4. A method as claimed in claim 1, wherein the plasma generator comprises a plurality of discrete plasma generators, each of the discrete plasma generators being disposed on the casing radially outward and entirely apart from the blade tips.

5. A method of operating a compressor having a row of blades for preventing a compressor stall, the method comprising the steps of:

mounting a plasma generator in a casing radially outwardly and apart from the blade tips wherein the plasma generator comprises a radially inner electrode and a radially outer electrode separated by a dielectric material; and supplying an AC potential to the radially inner electrode and the radially outer electrode;

wherein supplying the AC potential comprises pulsing the AC potential in-phase with a multiple of the vortex shedding frequency of the blade tip.

6. A method according to claim 5, wherein the dielectric material is disposed within a groove in a radially inwardly facing surface of the casing.

7. A method as claimed in claim 5, wherein the plasma generator comprises an annular plasma generator.

8. A method as claimed in claim 5, wherein the plasma generator comprises a plurality of discrete plasma generators, each of the discrete plasma generators being disposed on the casing radially outward and entirely apart from the blade tips.

9. A method of operating a gas turbine engine, the method comprising:

operating a compressor of a gas turbine engine, the compressor comprising at least one compression stage, the compression stage comprising a rotor comprising a plurality of blades comprising respective blade tips, the rotor rotating within an annular casing;

selectively activating a plasma generator associated with the compression stage of the compressor upon detection of compressor operating conditions near compressor stall conditions; and selectively turning off the plasma generator upon detection of healthy, steady state compressor operating conditions;

wherein the plasma generator is mounted to the annular casing and is disposed radially outward and entirely apart from the blade tips; and wherein activating the plasma generator comprises pulsing the plasma generator at a frequency that is a multiple of a number of blades associated with the rotor.

10. The method of claim 9, further comprising, before selectively activating the plasma generator, identifying the compressor operating conditions near the compressor stall conditions.

11. The method of claim 9, wherein the plasma generator comprises a radially inner electrode and a radially outer electrode separated by a dielectric material; and wherein the radially inner electrode and the radially outer electrode are disposed on the annular casing.

12. The method of claim 11, wherein the dielectric material is disposed within a groove in a radially inwardly facing surface of the annular casing.

13. The method of claim 9, wherein the plasma generator comprises a plurality of discrete plasma generators disposed at a plurality of locations associated with the compression stage.

14. The method of claim 9, wherein activating the plasma generator comprises forming an annular plasma between the annular casing and the blade tips such that an effective clearance produced by the annular plasma between the annular casing and the blade tips is smaller than a cold clearance between the annular casing and the blade tips.

15. A method of operating a gas turbine engine, the method comprising:

operating a compressor of a gas turbine engine, the compressor comprising at least one compression stage, the compression stage comprising a rotor comprising a plurality of blades comprising respective blade tips, the rotor rotating within an annular casing;

selectively activating a plasma generator associated with the compression stage of the compressor upon detection of compressor operating conditions near compressor stall conditions; and selectively turning off the plasma generator upon detection of healthy, steady state compressor operating conditions;

wherein the plasma generator is mounted to the annular casing and is disposed radially outward and entirely apart from the blade tips; and wherein activating the plasma generator comprises pulsing the plasma generator in phase with a multiple of a vortex shedding frequency of the blade tips.

16. The method of claim 15, further comprising, before selectively activating the plasma generator, identifying the compressor operating conditions near the compressor stall conditions.

17. The method of claim 15, wherein the plasma generator comprises a radially inner electrode and a radially outer electrode separated by a dielectric material; and wherein the radially inner electrode and the radially outer electrode are disposed on the annular casing.

18. The method of claim 17, wherein the dielectric material is disposed within a groove in a radially inwardly facing surface of the annular casing.

19. The method of claim 15, wherein the plasma generator comprises a plurality of discrete plasma generators disposed at a plurality of locations associated with the compression stage.

20. The method of claim 15, wherein activating the plasma generator comprises forming an annular plasma between the annular casing and the blade tips such that an effective clearance produced by the annular plasma between the annular casing and the blade tips is smaller than a cold clearance between the annular casing and the blade tips.

* * * * *